US008312755B1

(12) United States Patent
Steiner et al.

(10) Patent No.: US 8,312,755 B1
(45) Date of Patent: Nov. 20, 2012

(54) CRIMPING TOOL WITH THIRD HANDLE AND METHOD OF USE

(75) Inventors: Richard A. Steiner, East Haddam, CT (US); Joseph A. Krzyzanski, New Haven, CT (US)

(73) Assignee: Rostra Tool Company, Branford, CT (US)

( * ) Notice: Subject to any disclaimer, the term of this patent is extended or adjusted under 35 U.S.C. 154(b) by 196 days.

(21) Appl. No.: 11/986,820

(22) Filed: Nov. 28, 2007

(51) Int. Cl.
*B25B 7/12* (2006.01)
*B25B 7/00* (2006.01)

(52) U.S. Cl. ..... 72/409.11; 72/409.01

(58) Field of Classification Search ..... 72/409.01, 72/409.11, 409.12, 409.19, 450, 482.7, 407, 72/409.07, 409.13; 29/243.56, 282, 283.5; 81/427.5, 315, 338, 342, 425.5, 426, 426.5
See application file for complete search history.

(56) References Cited

U.S. PATENT DOCUMENTS

| | | | | |
|---|---|---|---|---|
| 3,732,720 | A * | 5/1973 | Cootes | 29/243.56 |
| 6,219,905 | B1 * | 4/2001 | Bollesen | 29/764 |
| 6,832,532 | B2 * | 12/2004 | Kilpela et al. | 81/315 |
| 2007/0289353 | A1 * | 12/2007 | Fiorisi | 72/409.19 |
| 2008/0163664 | A1 * | 7/2008 | Battenfeld | 72/409.12 |

* cited by examiner

*Primary Examiner* — Teresa M Ekiert
(74) *Attorney, Agent, or Firm* — Cantor Colburn LLP

(57) ABSTRACT

In a preferred embodiment, an apparatus, including: first and second handles; first and second crimping jaws operatively connected, respectively, to the first and second handles, such that moving the first and second handles toward each other causes the first and second crimping jaws to advance toward each other thereby to crimp a band around tubing or pipe; and a third handle rotatably attached to the first handle, such that a user of the apparatus manually moves the first handle toward the second handle by grasping the second handle and the third handle and moving them toward each other. A method of using the apparatus is also provided.

1 Claim, 10 Drawing Sheets

CRIMPING TOOL WITH THIRD HANDLE AND METHOD OF USE

BACKGROUND OF THE INVENTION

1. Field of the Invention

The present invention relates to crimping tools generally and, more particularly, but not by way of limitation, to a novel crimping tool having a third handle and method of use of the tool.

2. Background Art

Crimping tools are very useful items in the industry and, in one form, are used to crimp typically stainless steel bands over typically plastic tubing or pipe to attach the end of the tubing or pipe to a typically metallic connector.

Unfortunately, especially with tubing or pipe on the order of about one-half inch in diameter, a slightly, or partially, crimped band cannot be slid along the tubing or pipe, a feature not possible with conventional crimping tools, due to the jaws of the tools not opening far enough.

Accordingly, it is a principal object of the present invention to provide a crimping tool for bands that will allow a partially crimped band to be slid along a tubing or pipe.

Other objects of the present invention, as well as particular features, elements, and advantages thereof, will be elucidated in, or be apparent from, the following description and the accompanying drawing figures.

SUMMARY OF THE INVENTION

The present invention achieves the above object, among others, by providing, in a preferred embodiment, an apparatus, comprising: first and second handles; first and second crimping jaws operatively connected, respectively, to said first and second handles, such that moving said first and second handles toward each other causes said first and second crimping jaws to advance toward each other thereby to crimp a band around tubing or pipe; and a third handle rotatably attached to said first handle, such that a user of said apparatus manually moves said first handle toward said second handle by grasping said second handle and said third handle and moving them toward each other. A method of using said apparatus is also provided.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
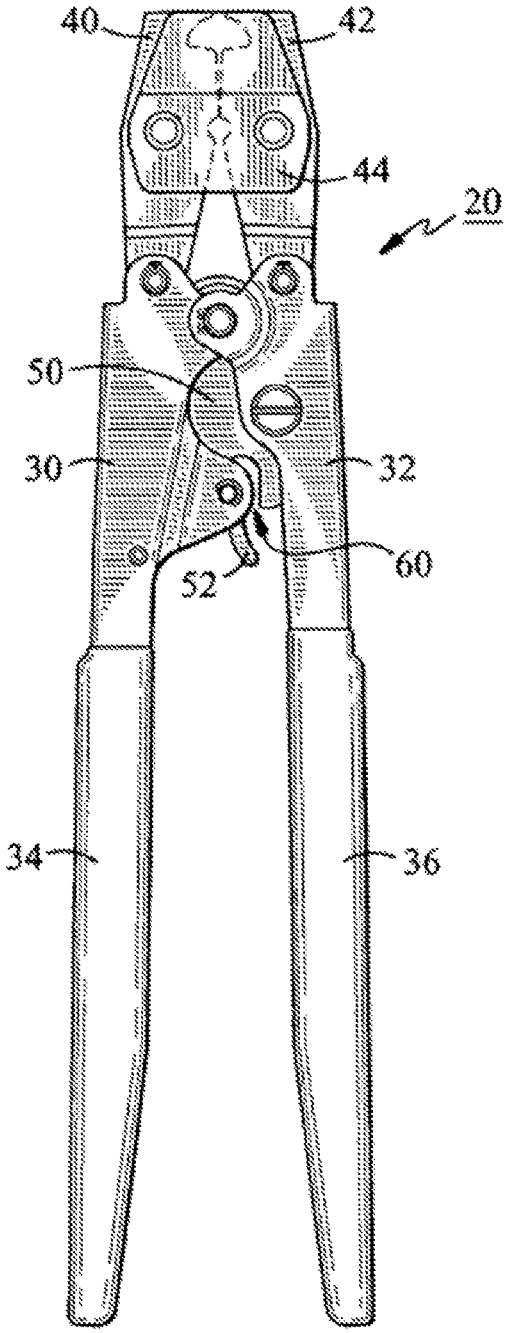
FIG. 1 (Prior Art)
FIG. 1 is front elevational view of a conventional crimping tool in closed or crimping position.

Reference should now be made to the drawing figures, provided for purposes of illustration only, and on which the figure numerals in parentheses (when used) refer the reader to the figure in which the element(s) being described are more fully shown, although the element(s) may be shown on other figures also.

FIG. 1 illustrates a conventional crimping tool, generally indicated by the reference numeral 20. Crimping tool 20 includes two handles 30 and 32, preferably constructed of a metal, disposed at the distal end of the crimping tool and covered, respectively, with a plastic material 34 and 36 for the comfort of the user of the crimping tool. Operatively connected to handles 30 and 32 at the proximal end of the crimping tool are two crimping jaws 40 and 42, respectively, preferably constructed of a metal, connected by a link 44. Handles 30 and 32 and crimping jaws 40 and 42 are arranged such that pressing the handles together causes the crimping jaws to advance toward each other to crimp a band. Although not clearly seen by reference to FIG. 1 alone, there is shown a ratchet mechanism 50 engaged by a spring loaded ratchet engaging mechanism 52. When spring loaded ratchet engaging mechanism 52 reaches opening 60 on ratchet mechanism 50, the advancement of crimping jaws 40 and 42 ceases as does the crimping action of the crimping jaws, the band being crimped.

Figure 2:
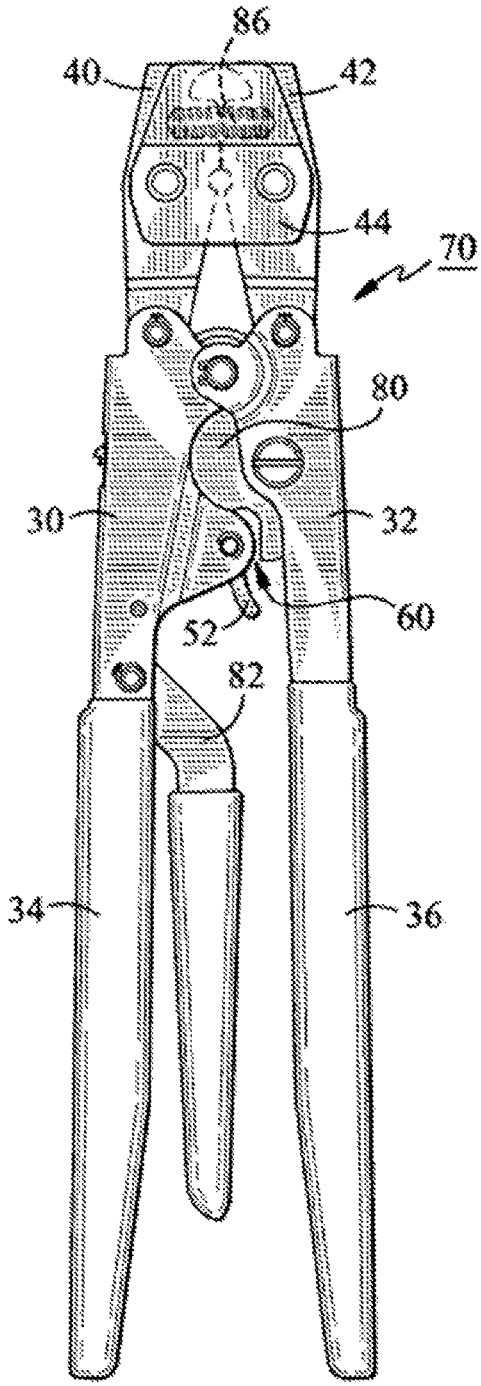
FIG. 2 is a front elevational view of the crimping tool of the present invention in closed or crimping position.

FIG. 2 illustrates a crimping tool constructed according to the present invention, generally indicated by the reference numeral 70. In addition to the conventional elements of crimping tool 20 (FIG. 1), there has been added an extended ratchet 80 and a third handle 82, preferably constructed of a metal, rotatably attached to handle 30. Due to the added drag of crimping tool 70, a spring 86 as been provided between crimping jaws 40 and 42 to assist in forcing the crimping jaws apart.

Figure 3:
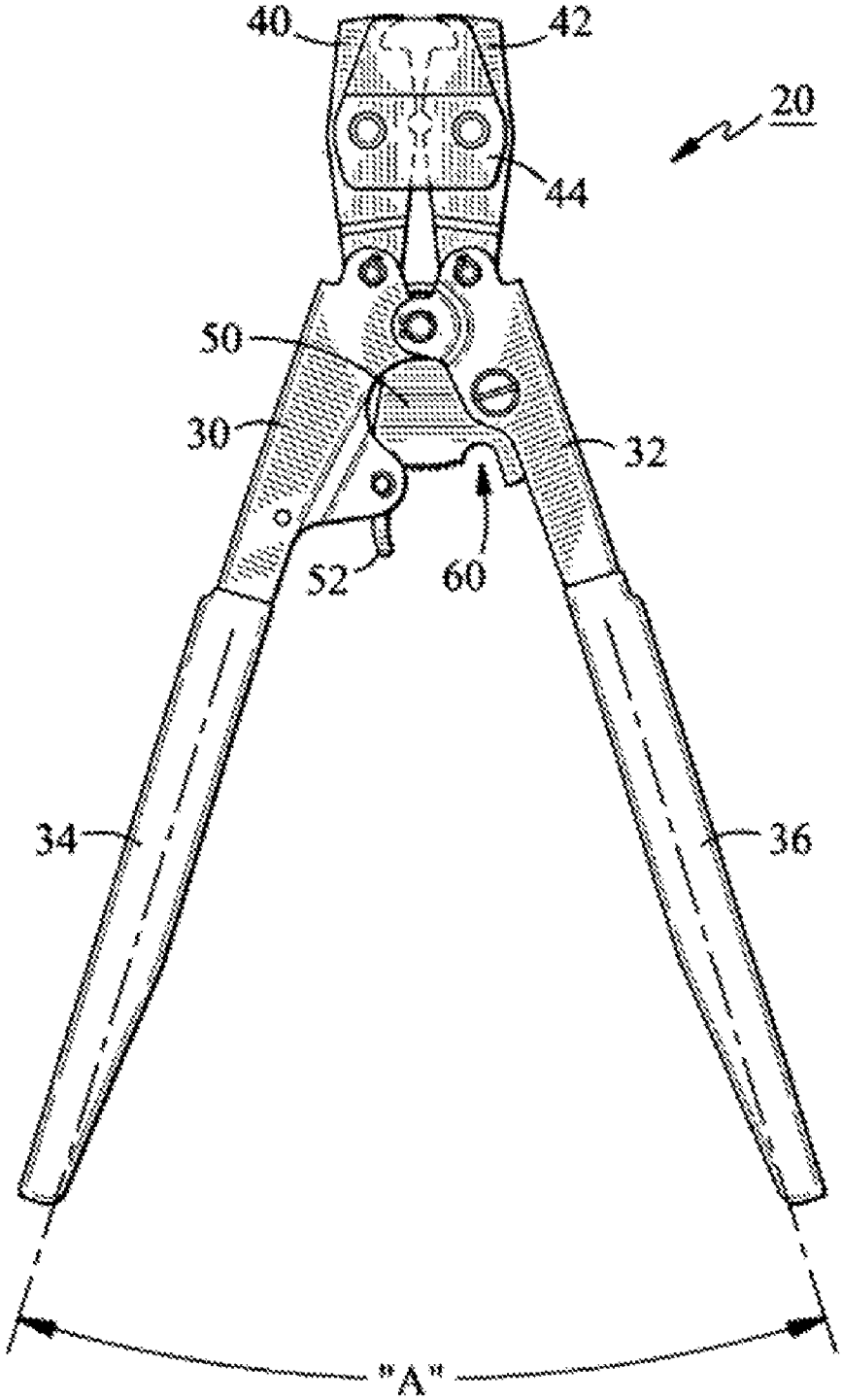
FIG. 3 (Prior Art)
FIG. 3 is a front elevational view of a conventional crimping tool in open position.

FIG. 3 illustrates crimping tool 20 (FIG. 1) in its open position, with spring loaded ratchet engaging mechanism 52 just engaging ratchet mechanism 50. In this position, angle "A" on FIG. 3 is on the order of about thirty five degrees.

Figure 4:
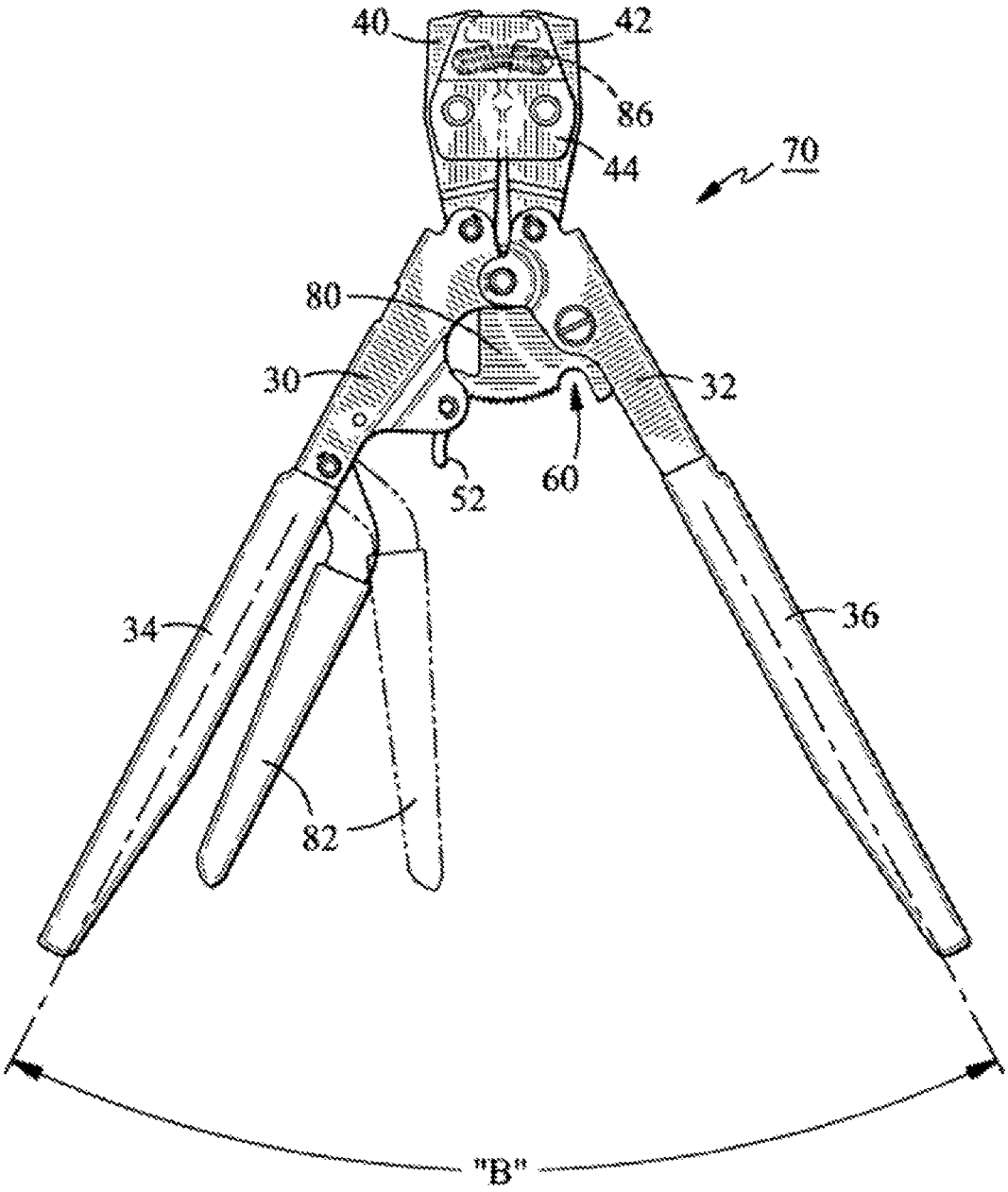
FIG. 4 is a front elevational view of the crimping tool of the present invention in open position.

FIG. 4 illustrates crimping tool 70 in its open position, with spring loaded ratchet engaging mechanism 52 just engaging ratchet mechanism 50. In this position, angle "B" on FIG. 4 is on the order of about fifty-five degrees.

Figure 6:
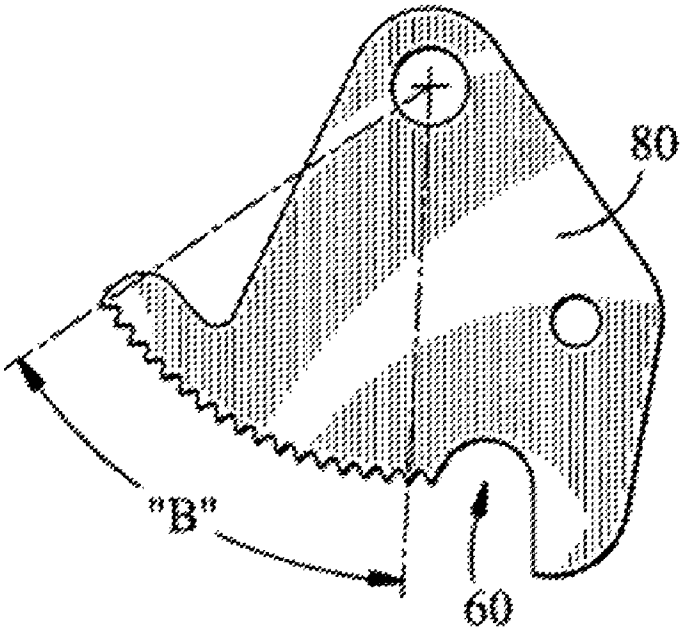
FIG. 6 is a fragmentary, front elevational view of the ratchet mechanism of the crimping tool of the present invention.
Figure 5:
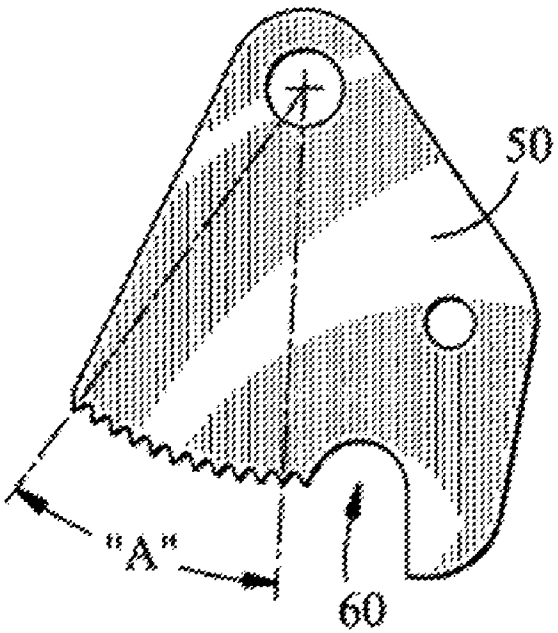
FIG. 5 (Prior Art)
FIG. 5 is a fragmentary, front elevational view of the ratchet mechanism of a conventional crimping tool.

FIGS. 5 and 6 illustrate the differences in ratchet mechanisms 50 and 80, with the angle "A" on FIG. 5 being on the order of about thirty five degrees, while the angle "B" on FIG. 6 is on the order of about fifty five degrees.

Figure 8:
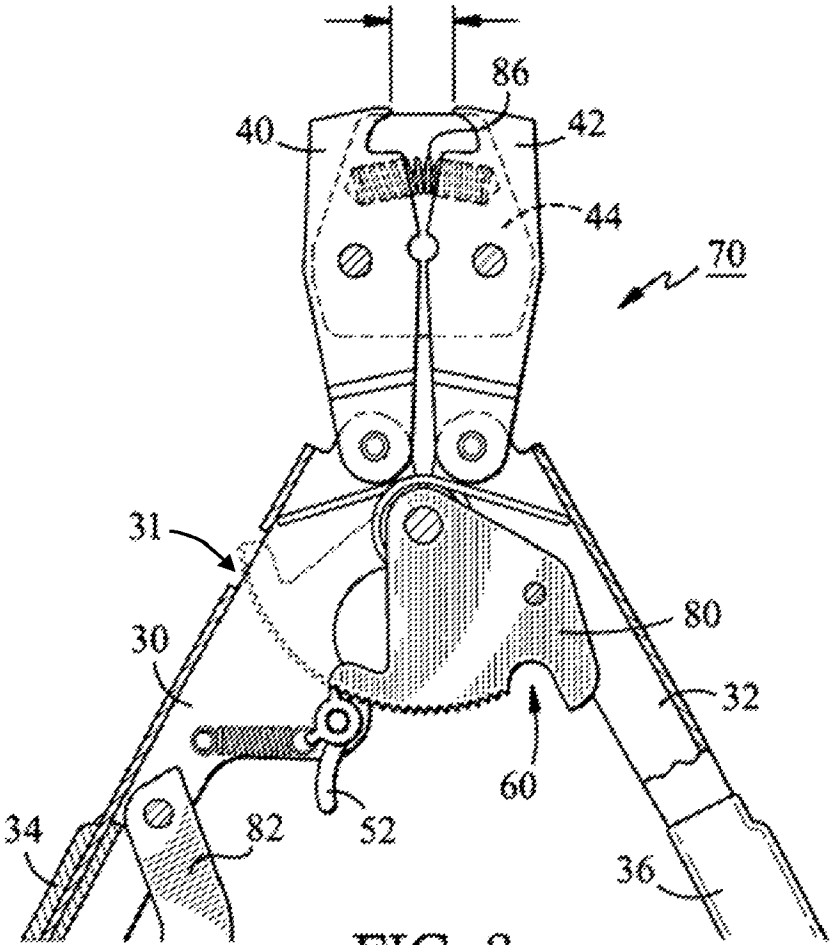
FIG. 8 is a fragmentary, front elevational view, partially in cross-section, of the crimping tool of the present invention in open position, with its ratchet mechanism just engaged.
Figure 7:
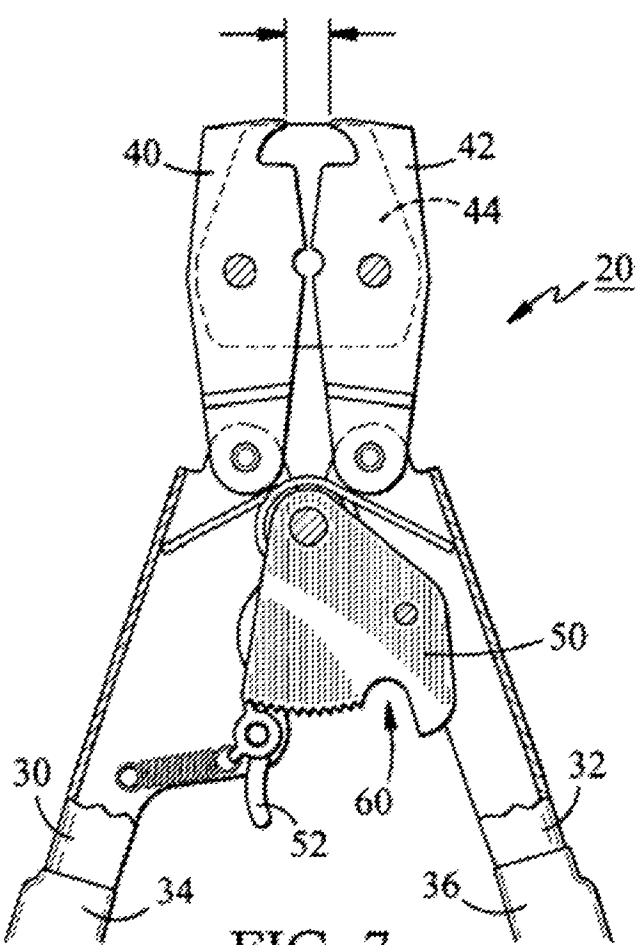
FIG. 7 (Prior Art)
FIG. 7 is a fragmentary, side elevational view, partially in cross-section, of a conventional crimping tool in open position, with its ratchet mechanism just engaged.

FIGS. 7 and 8 illustrate the differences in the openings provided by in Jaws 40 and 42 between crimping tool 20

(FIG. 3) and crimping tool 70 (FIG. 4), in both cases with spring-loaded ratchet engaging mechanism 52 just engaging ratchet mechanism 50 of crimping tool 20 and the spring-loaded ratchet engaging mechanism just engaging ratchet mechanism 80 of crimping tool 70. It will be seen that the opening of crimping jaws of tool 70 is much greater than the opening of the crimping jaws of tool 20. Further illustrated in FIG. 8 is an opening 31 in the handle 30. The opening 31 is arranged to allow a projection on the ratchet mechanism 52 to extend through when the handle 30 is in the closed position as shown by the dashed outline of the ratchet mechanism 50.

Figure 9:
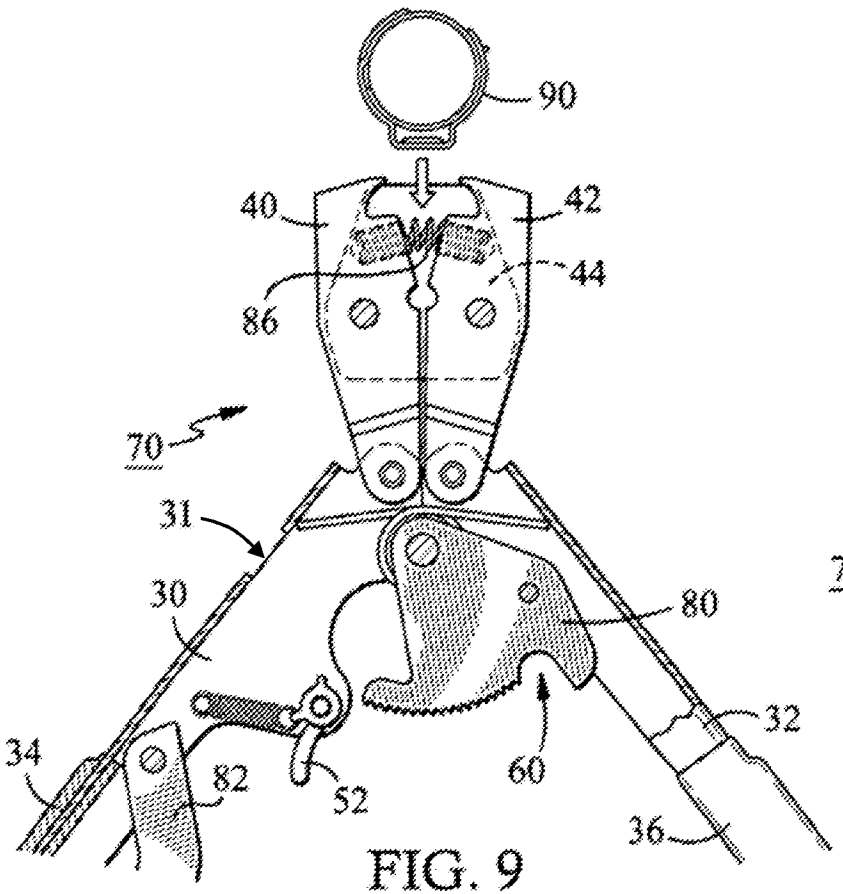
FIG. 9 is a fragmentary, front elevational view, partially in cross-section, of the crimping tool, with a band being inserted in the crimping tool.

FIG. 9 illustrates crimping tool 70 in its wide open position, with spring loaded ratchet engaging mechanism 52 not engaging ratchet mechanism 80 and with a band being inserted in the crimping jaws 40 and 42 of the crimping tool.

Figure 10:
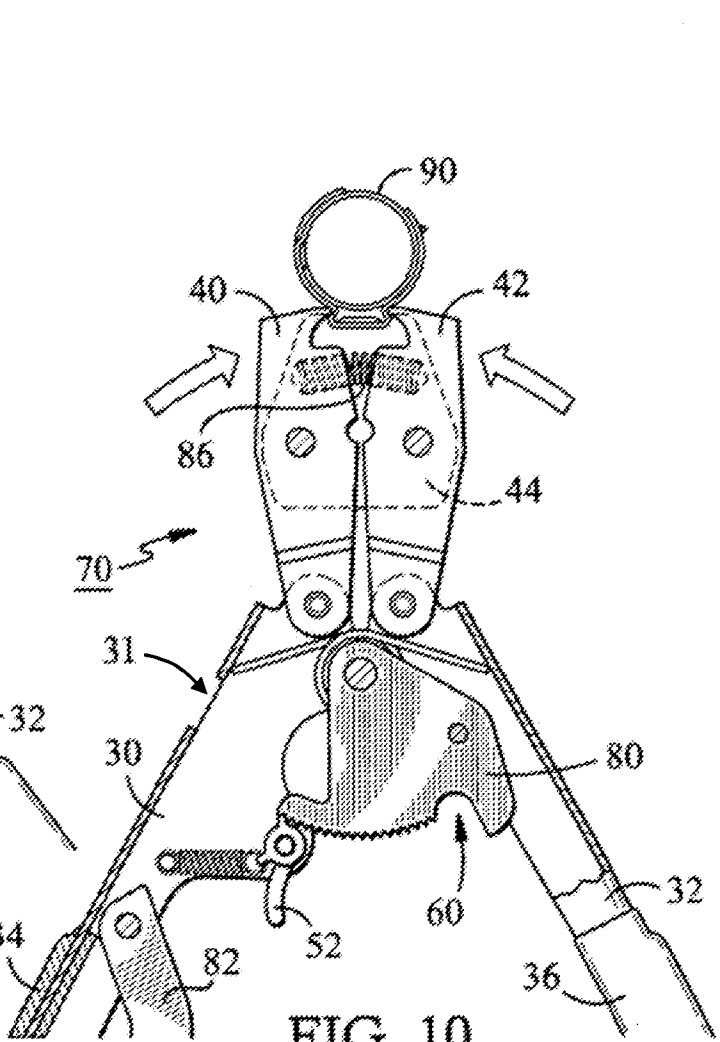
FIG. 10 is a fragmentary, front elevational view, partially in cross-section, of the crimping tool, with a band inserted therein and the ratchet mechanism thereof just engaged to slightly crimp the band.

FIG. 10 illustrates crimping tool 70 just slightly, or partially, crimping band 90, as indicated by the arrows on FIG. 10. It will be understood that crimping tool 70 has been brought to this position by manually drawing third handle 82 toward handle 32.

Figure 11:
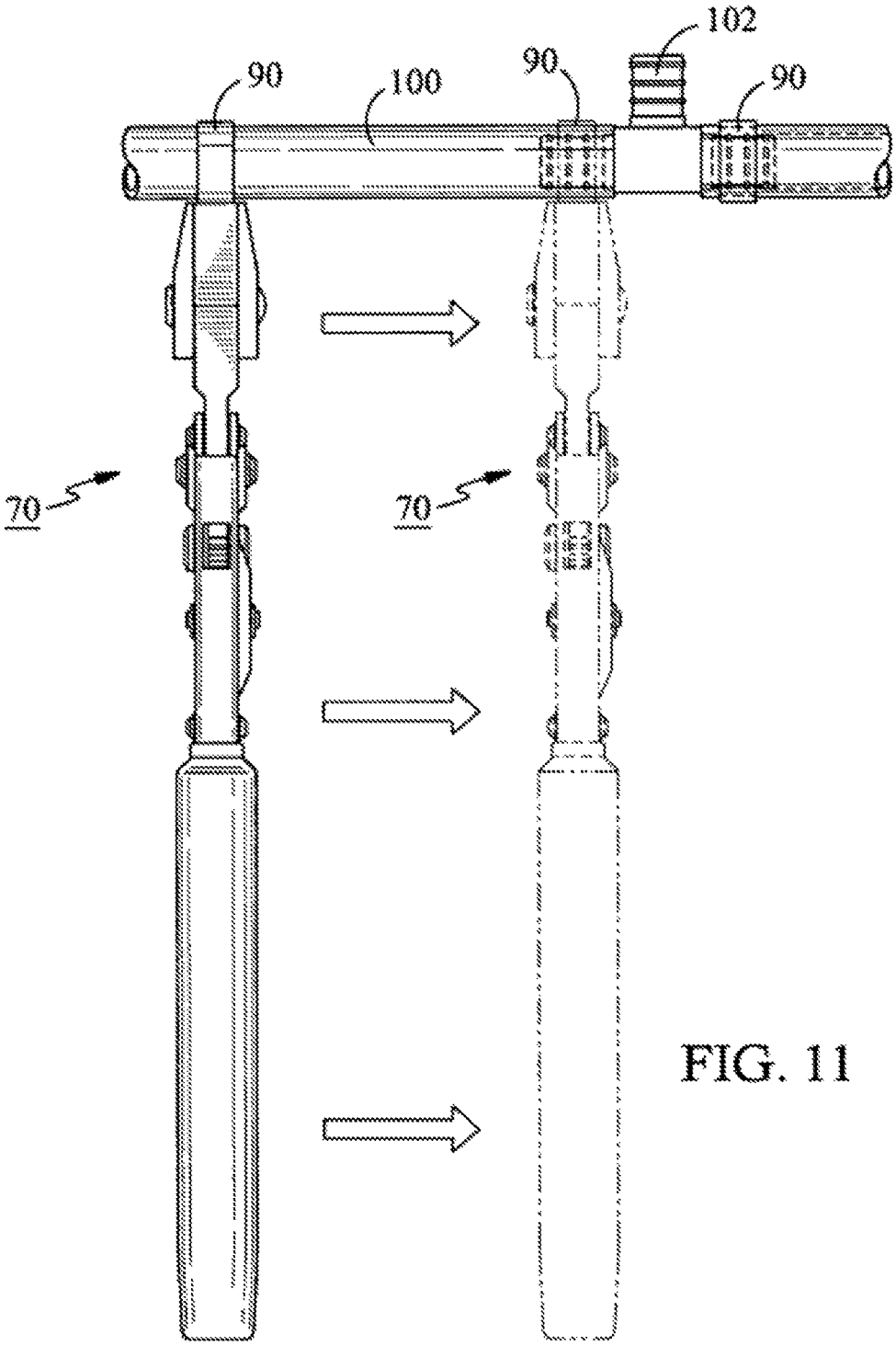
FIG. 11 is a side elevational view of the crimping tool of the present invention, with a partially crimped band being slid along a tubing or pipe.

FIG. 11 illustrates crimping tool 70 partially crimping band 90 and sliding the band along tubing or pipe 100 toward connector 102 as indicated by the arrows on FIG. 11.

Figure 12A:
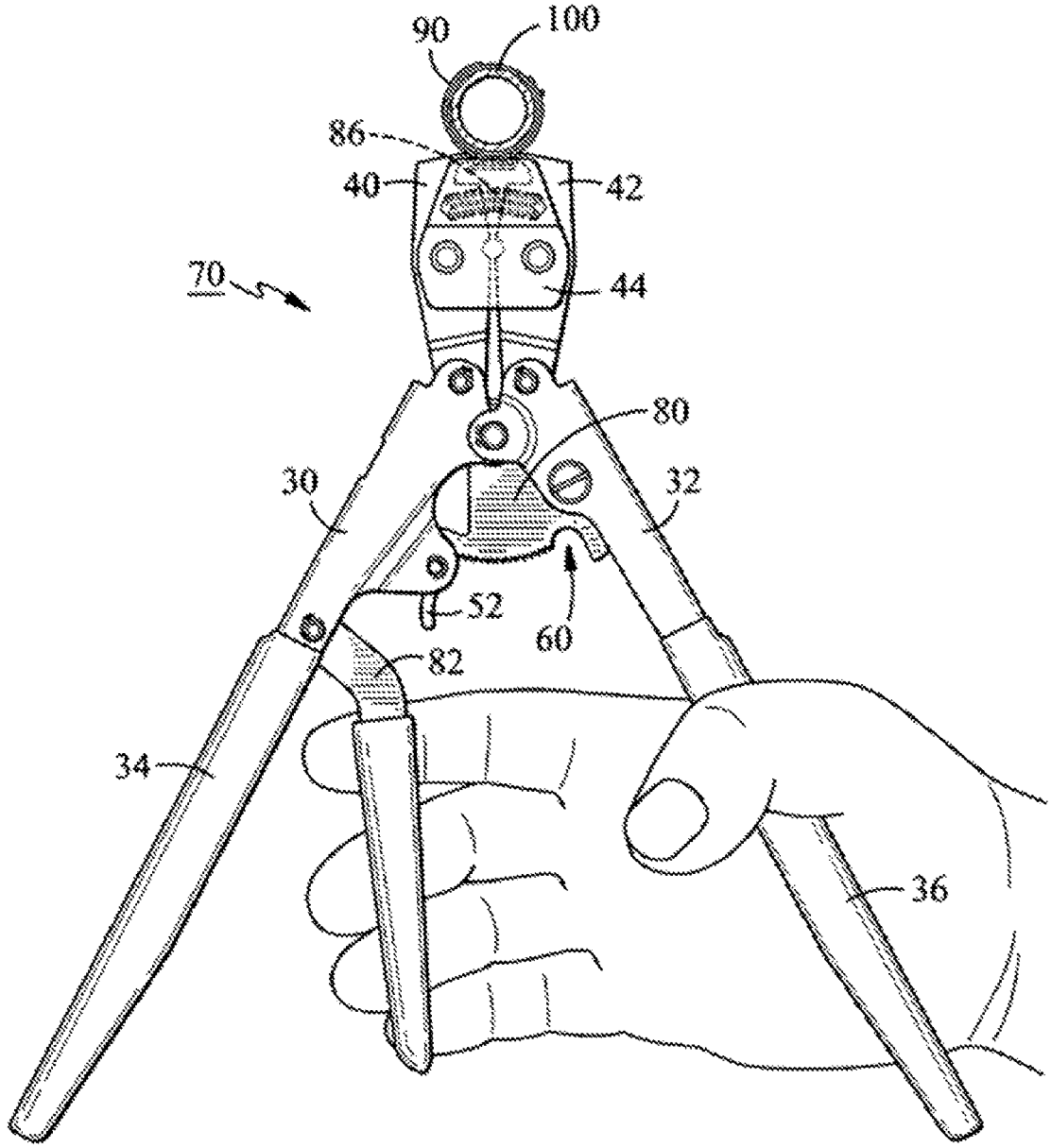
FIGS. 12A-12C are front elevational views showing the steps in crimping a band around the tubing or pipe.
Figure 12B:
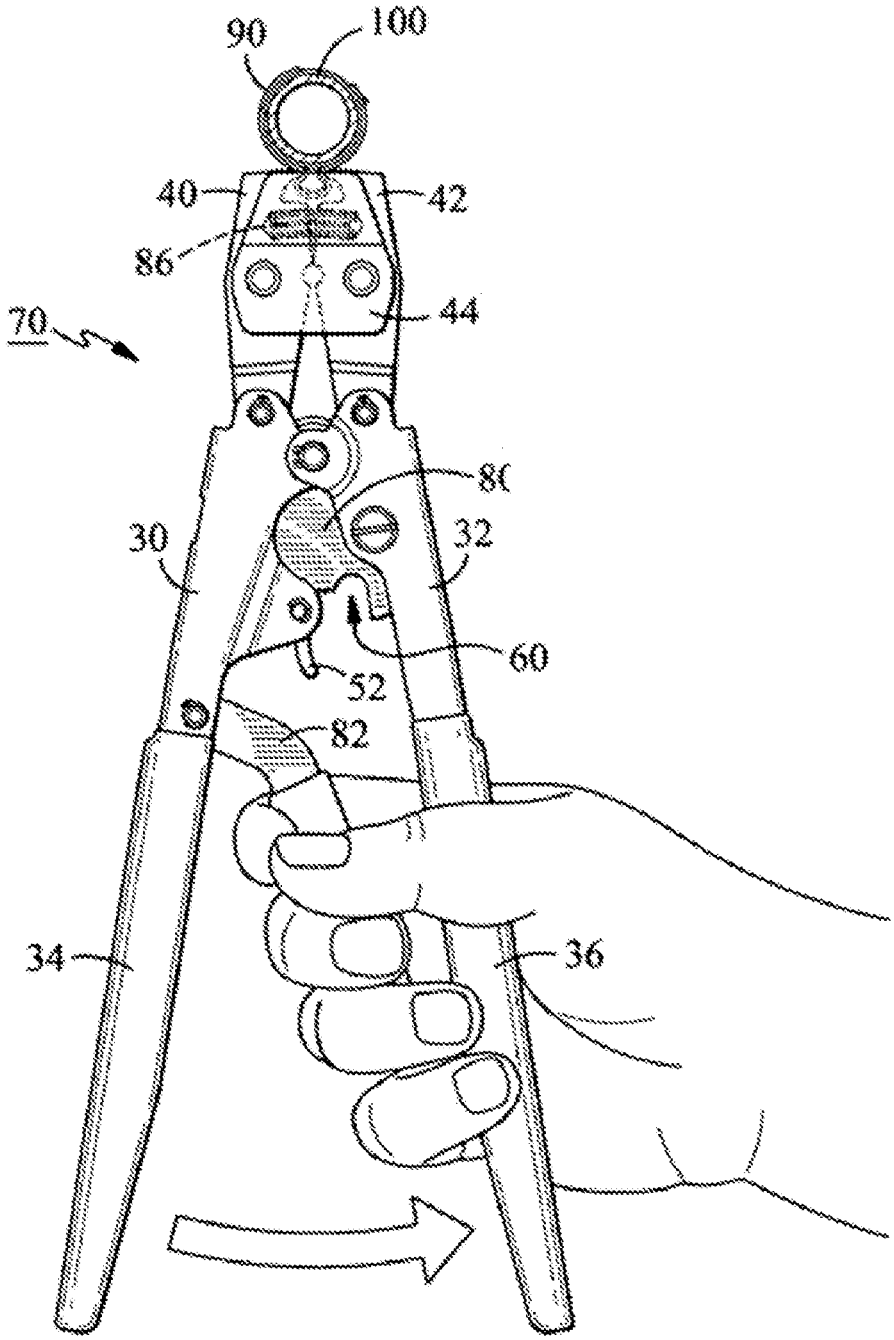
Figure 12C:
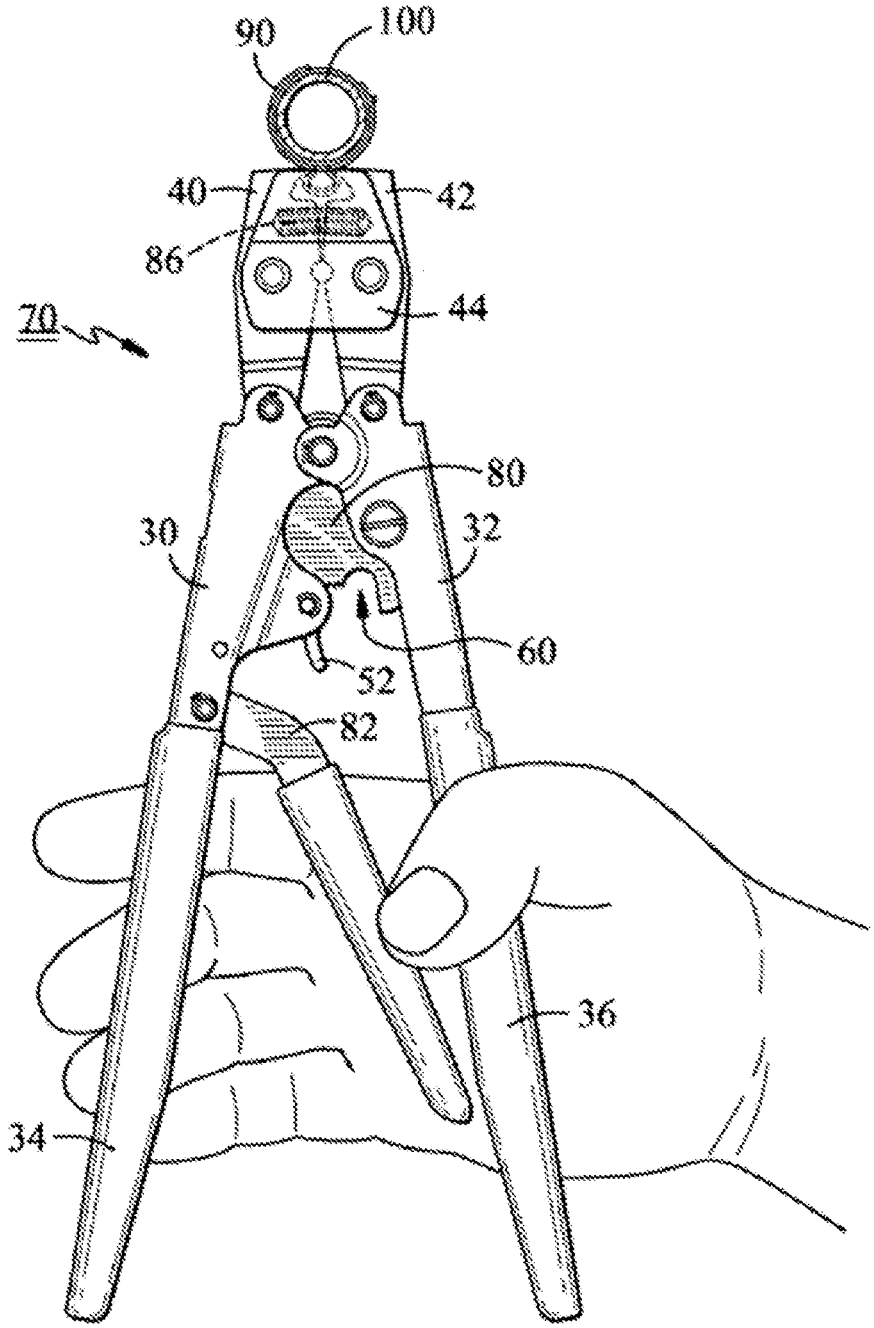

FIGS. 12A-12C illustrate the closing of crimping tool 70. On FIG. 12A, the manual drawing together of handle 32 and third handle 82 causes crimping jaws 40 and 42 to more tightly crimp band 90 around tubing or pipe 100. See FIG. 12B. In this range, it is too difficult to draw handles 30 and 32 together. At the point reached in FIG. 12C, it is possible to manually encircle handles 30 and 32 and to draw together these handles and the crimping can be finished.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction and/or method without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. An apparatus comprising:

a first handle having a pivot, the handle having a side with a first opening positioned adjacent the pivot;

a second handle coupled to the first handle by the pivot;

a first crimping jaw operably coupled to the first handle;

a second crimping jaw operatively coupled to the second handle, wherein moving said first handle and said second handle from a first position to a second position causes said first crimping jaw and said second crimping jaw to advance toward each other thereby to crimp a band around tubing or pipe;

a third handle rotatably attached to said first handle between said first handle and said second handle;

an engaging lever operably coupled to the first handle;

a ratchet coupled to the second handle and operably coupled to the engaging lever, the ratchet having a body with a projection extending from one side, the ratchet further having a plurality of teeth along the side and the projection, wherein the projection extends into the first opening when in the second position;

a first biasing member disposed between the first crimping jaw and the second crimping jaw, wherein the first biasing member is a compression spring; and a second biasing member disposed between the first handle and the second handle, wherein the second biasing member is a torsion spring disposed about the pivot.

* * * * *